US010857564B1

(12) United States Patent
Horian

(10) Patent No.: US 10,857,564 B1
(45) Date of Patent: Dec. 8, 2020

(54) GLUE GUN

(71) Applicant: Richard C. Horian, Riverview, FL (US)

(72) Inventor: Richard C. Horian, Riverview, FL (US)

( * ) Notice: Subject to any disclaimer, the term of this patent is extended or adjusted under 35 U.S.C. 154(b) by 0 days.

(21) Appl. No.: 16/832,156

(22) Filed: Mar. 27, 2020

(51) Int. Cl.
*B05C 17/005* (2006.01)
*B05C 17/00* (2006.01)

(52) U.S. Cl.
CPC ..... *B05C 17/0053* (2013.01); *B05C 17/002* (2013.01); *B05C 17/0052* (2013.01); *B05C 17/001* (2013.01); *B05C 17/00526* (2013.01)

(58) Field of Classification Search
CPC ..... B05C 17/0053; B05C 17/0052; B05C 17/002; B05C 17/00526; B05C 17/001
See application file for complete search history.

(56) References Cited

U.S. PATENT DOCUMENTS 3,743,142 A * 7/1973 Elliott ..... B29C 66/861 222/146.5
4,457,457 A * 7/1984 Dziki ..... B05C 17/00543 219/230
4,523,705 A * 6/1985 Belanger ..... B05C 17/0053 222/146.5
4,660,743 A * 4/1987 Speisebecher ..... B05C 17/0053 222/146.5
4,664,296 A * 5/1987 Dziki ..... B05C 17/00533 219/230
4,998,698 A * 3/1991 Martinson ..... B05C 17/00523 211/60.1
5,105,987 A * 4/1992 Quinn ..... B05C 17/0054 221/279
5,881,912 A * 3/1999 Bokros ..... B05C 17/0053 219/227
5,881,923 A * 3/1999 Bokros ..... B05C 17/0053 219/227
5,881,924 A * 3/1999 Bokros ..... B05C 17/00526 219/227
6,041,972 A * 3/2000 Maayeh ..... B05C 17/0053 219/247
6,223,950 B1 * 5/2001 Lasko ..... B05C 17/0053 219/426
6,820,768 B2 * 11/2004 Belanger ..... B05C 17/00526 222/146.5
9,586,229 B1 * 3/2017 Lee ..... B05C 17/0053
9,643,200 B2 * 5/2017 Belanger ..... B05B 11/048
10,413,931 B1 * 9/2019 Drachenberg ..... B05C 17/0052
10,569,294 B1 * 2/2020 Lee ..... B05C 17/00526

* cited by examiner

*Primary Examiner* — Nicolas A Arnett
(74) *Attorney, Agent, or Firm* — Karish & Bjorgum, PC

(57) ABSTRACT

A hot melt glue gun includes a charging cylinder mounted to the rear of the gun with chambers for holding solid glue sticks. The cylinder is mounted to the hot melt gun housing via a centered shaft allowing it to revolve circumferentially. The cylinder is mounted in a position on the back of the glue gun so that each chamber when rotated to the top aligns with the glue stick entry port in the back of the glue gun. Each chamber has resilient flanges within the chamber that cause friction when a glue stick is inserted into the chamber, thus lightly securing the glue stick before it is pushed forward into the glue gun port and taken up by the trigger activated forward grip.

4 Claims, 4 Drawing Sheets

GLUE GUN

BACKGROUND OF THE INVENTION

The field of the present invention is hot melt glue guns.

Electric glue guns use a rod shaped adhesive formed as a glue stick that is solid at room temperature and then melts when a heating element positioned inside the gun liquefies the adhesive as the hot melt glue stick progresses past the heating element and leaves the gun in liquid form via a nozzle at the front of the gun. The solid hot melt glue stick first enters the glue gun through a glue stick entry port at the rear of the gun aligned with a barrel extending to the nozzle. The glue stick then enters friction grippers that secure the glue stick. A trigger located at the underside of the gun progresses the grippers to move the glue stick forward with each squeeze of the trigger. The glue stick melts as it passes through the melt zone and is forced out of the front nozzle of the gun as the next squeeze of the trigger forces the glue stick further forward to melt and progress the molten glue until the glue stick is used up.

Hot melt glue guns have been used for decades, varying very little from their original design. One inconvenience is that the guns use only one glue stick at a time. This means that another glue stick must be loaded separately to continue the gluing process. This interruption can be disadvantageous in the gluing operation.

Another problem working with conventional hot melt glue guns is that the glue sticks are hard to keep in the gun entry port before being secured by the trigger gripper. If the gun is tilted backward before the gripper secures the stick, the glue stick will fall out of the gun.

SUMMARY OF THE INVENTION

The present invention is directed to a charging cylinder for a hot melt glue gun for continuously advancing hot melt glue without having to reload the glue gun. The charging cylinder includes a shaft extending rearwardly from the glue gun rotatably mounting a cylinder having a plurality of chambers parallel to the shaft and equidistantly spaced from the shaft. The chambers can be selectively aligned with the gun to feed hot melt glue sticks into the gun. Elements may additionally be used to bias retention of the hot melt glue sticks toward the gun.

Accordingly, it is an object of the present invention to provide an improved hot melt glue gun. Further objects and advantages will appear hereinafter.

DETAILED DESCRIPTION OF THE PREFERRED EMBODIMENTS

Figure 1:
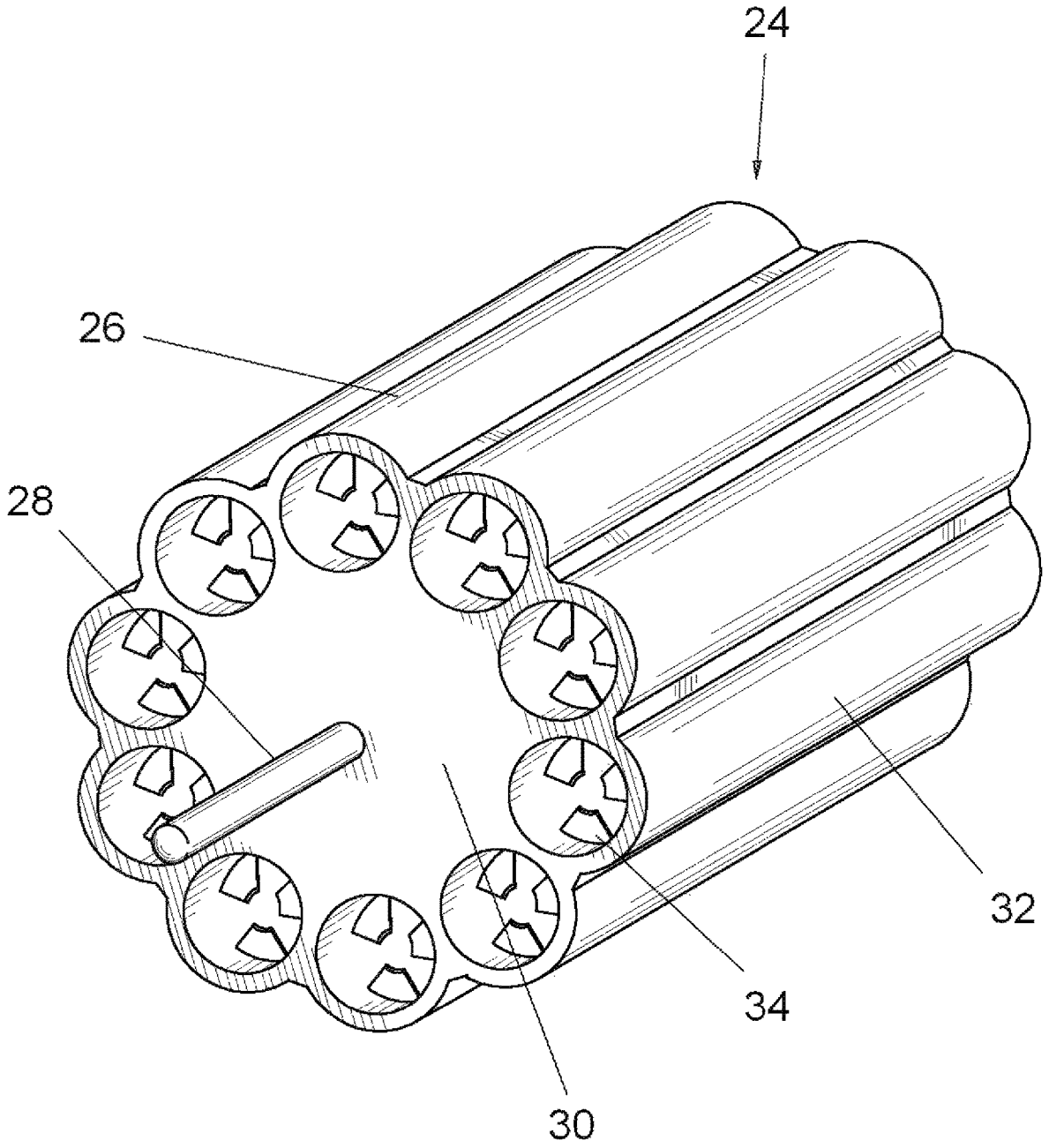
FIG. 1 is an isometric front view of a cylinder for a hot melt glue gun.
Figure 2:
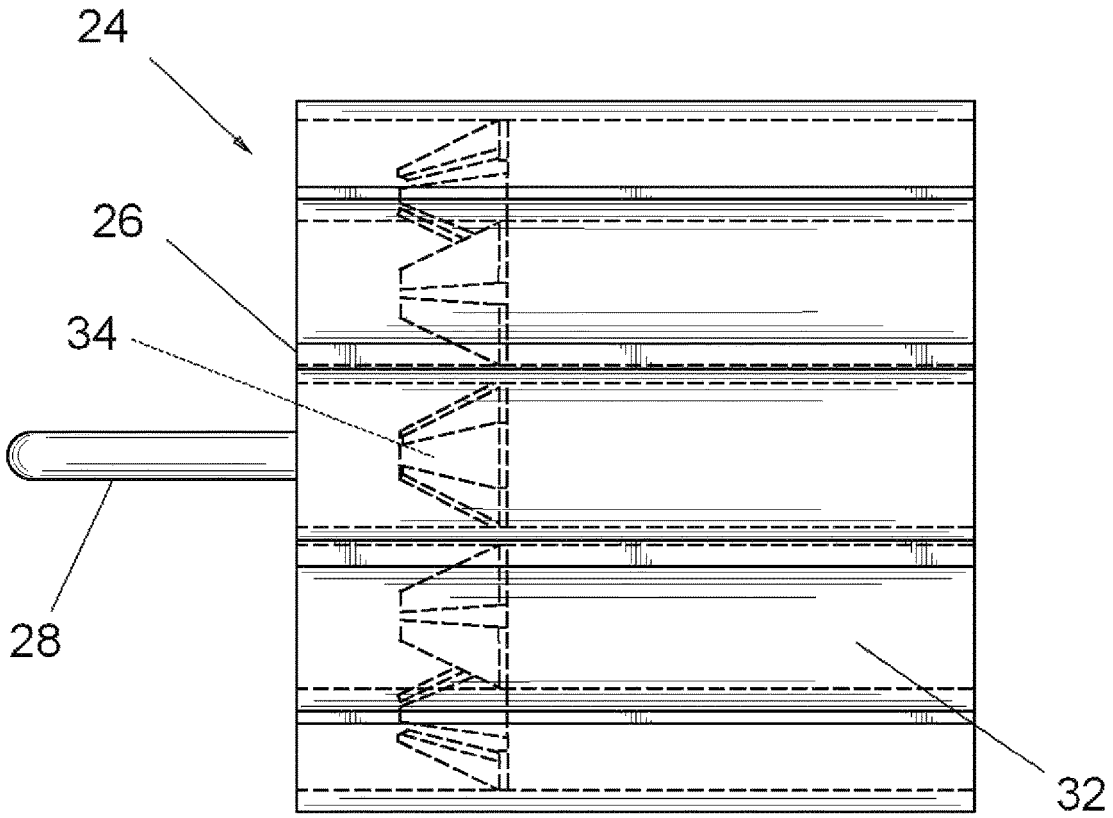
FIG. 2 is a side view of the cylinder for a hot melt glue gun.
Figure 3:
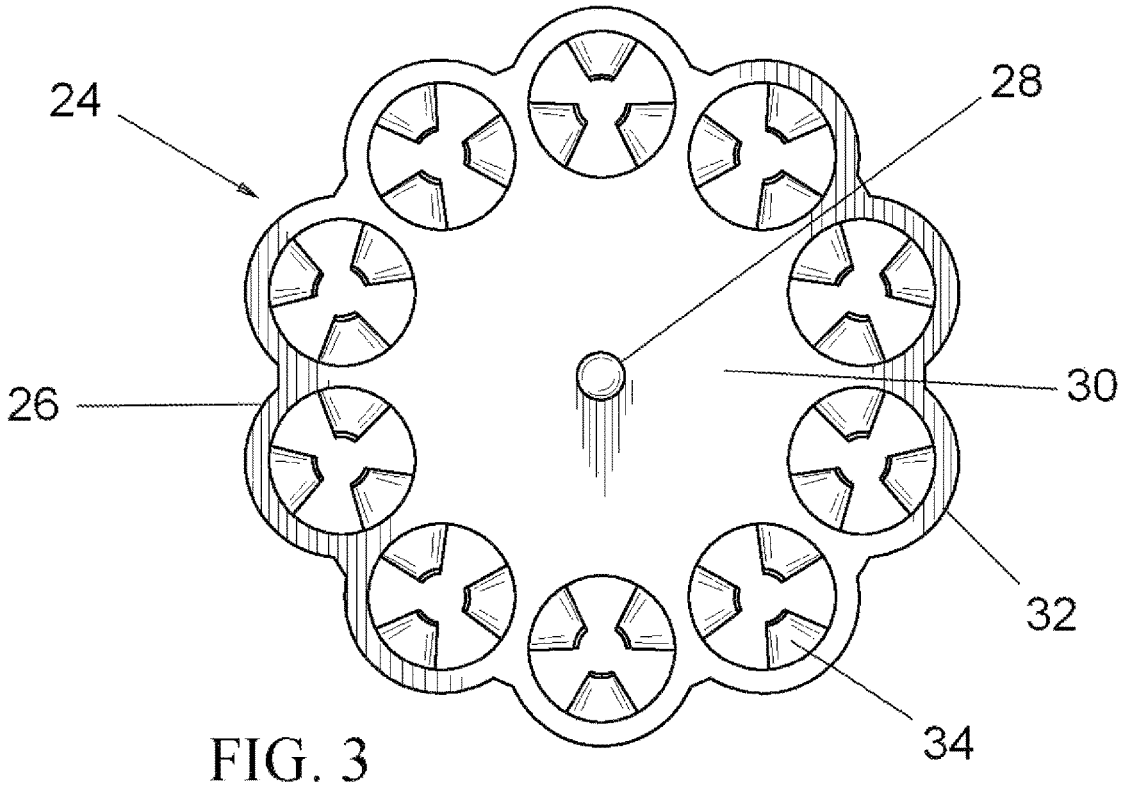
FIG. 3 is an end view of the cylinder for a hot melt glue gun.

Turning in detail to the drawings, the basic design of electric glue guns 10 need not be changed from its current popular configuration consisting of a pistol shaped housing 12 including an open glue stick entry port 14 at the rear of the gun 10 that will accept a solidified glue stick 16 made of glue that is solid at room temperature. The glue stick 16 is pushed forward until it engages rubber like grippers controlled by a trigger mechanism 18 located under the housing of the glue gun 10. The glue gun 10 is then operated by squeezing the trigger 18 beneath the body of the gun 10. The trigger 18 is squeezed to advance the glue stick 16 forward into the melt zone through a barrel 20. Each squeeze of the trigger 18 will force molten liquefied glue out of the front nozzle 22 until the glue stick 16 is depleted.

Figure 4:
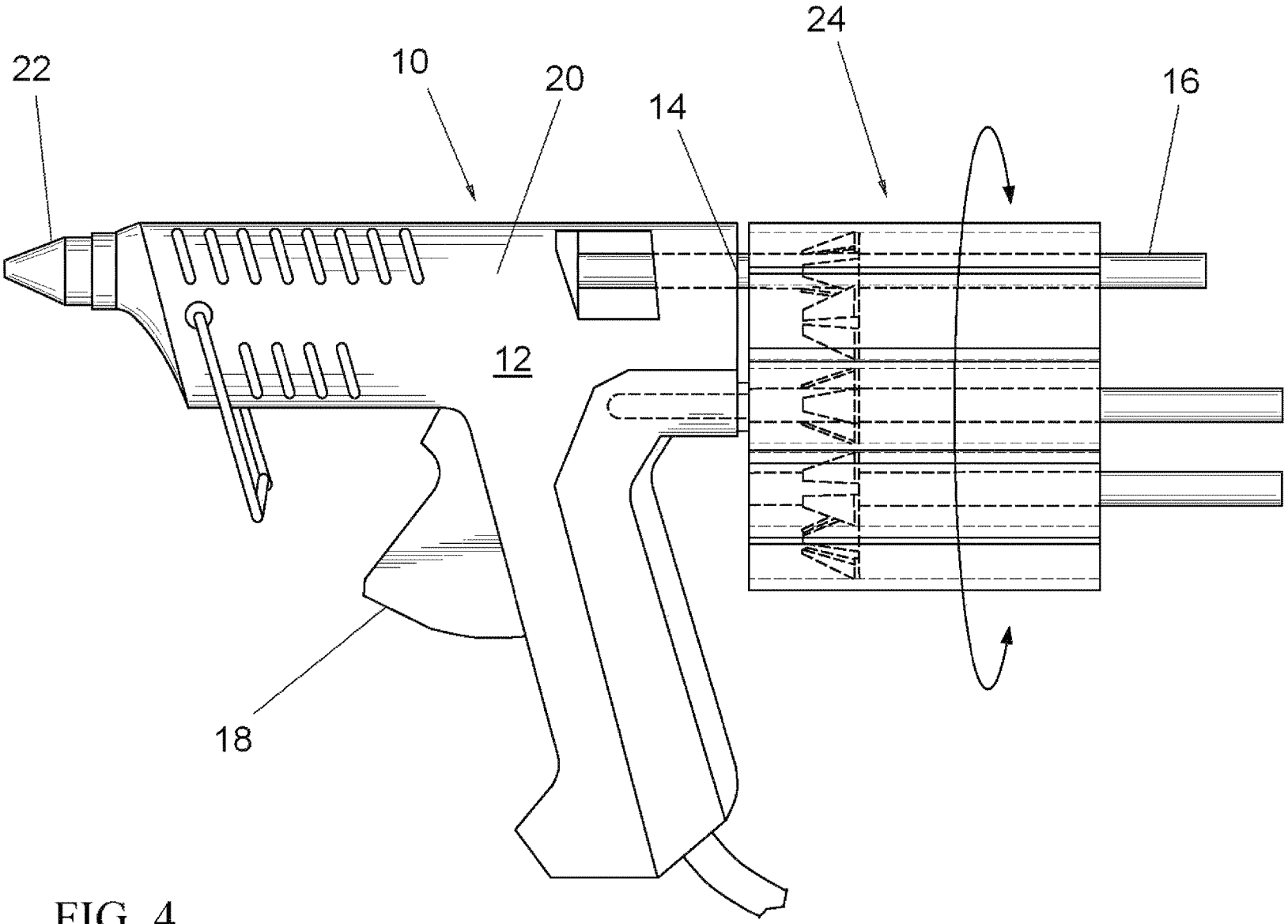
FIG. 4 is a side view of a hot melt glue gun with the charging cylinder mounted thereon.
Figure 5:
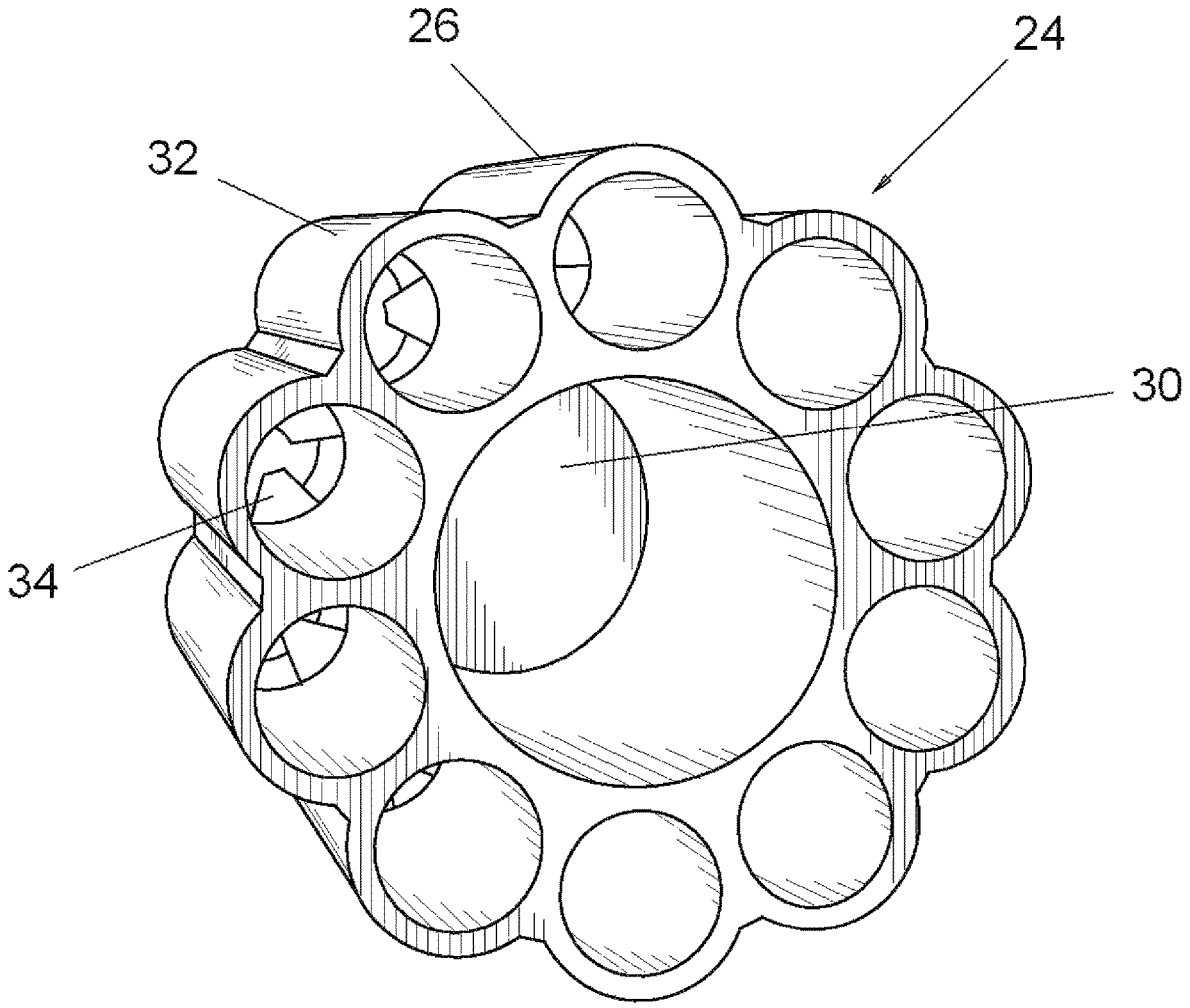
FIG. 5 is an isometric back view of the cylinder for a hot melt glue gun.

A charging cylinder 24 is mounted at the back of the gun housing 12. A cylinder 26 in the preferred embodiment takes a cylindrical shape with its center line positioned below the glue stick entry port 14 on the gun 10. The cylinder 26 is allowed to freely revolve circumferentially in either direction. There is a mounting shaft 28 in the center of the cylinder that is inserted in the back of the glue gun 10 and extends rearwardly to mount the cylinder 26. The shaft 28 is secured by any means that allows the cylinder 26 to rotate freely and still remain securely attached to the gun 10. In FIG. 4, the shaft 28 is shown extending into the body of the glue gun. This may be permanent or an extractable friction fit. The shaft 28 is located on the gun 10 directly below the glue stick entry port 14 spaced laterally a first distance. An integral plate 30 extends outwardly from the shaft 28 to mount the cylinder 26 thereon.

The cylinder 26 includes two or more chambers 32. The chambers 32 are arranged parallel to one another and are equidistantly spaced from the shaft 28 by the first distance that the shaft is distanced from the glue stick entry port 14. Ten chambers 32 are shown in the preferred embodiment. Each of the chambers 32 is open at both ends and is sized to receive hot melt glue sticks 16 which are employed with the gun 10, therefore no more than matching the cross-sectional dimension of the glue stick entry port 14. As the cylinder 26 is rotated, each chamber 32 in the top position can be positioned on center with the glue stick entry port 14 of the glue gun 10. It is important to note that just 10 chambers of 4" glue sticks will allow a full 40" of continuous glue stick application without reloading the chambers. The length of each chamber 32 is shorter than the distance from the glue stick entry port 14 to the nozzle 22.

Inside of each chamber 32 is one or more elastic friction elements 34. Three elements 34 are shown in each chamber 32 in the preferred embodiment. These elements 34 may be a separate attachment or part of the molded wall of the chamber 32. They preferably consist of one or more raised member flanges 34 to apply enough friction to a glue stick 16 to hold it in place with just enough strength to resist extraction by falling out if the gun 10 if the gun 10 is tilted backward but not enough strength to prevent the glue stick 16 from progressing forward when reaching the firm grippers of the trigger 18 to advance the glue stick 16 forward through the barrel 20 of the gun 10. The elastic friction element or elements 34 may also be made of a second separate piece made of any material attached to the chamber 32 to act as a securement flange to accomplish the same purpose. Examples of this may be a bristled filament, grip or insulation material that has relatively soft protruding bristles to act to center and temporarily secure the glue stick in the center of the chamber 32. The element or elements 34 could also be made of plastic foam or woven or non-woven bristle material. The reason the element or elements 34 may be used is that hot melt glue sticks 16 are not precision manufactured and may be extruded in varying diameters by as much as 1/16" or more. This prevents the practicality of molding the chambers 32 with a precise diameter dimension to accomplish a guaranteed friction fit. In the preferred embodiment, the elastic friction elements 34 are inclined toward the hot melt glue gun within the chamber wall to contact a glue stick 16 inserted therein with biased resistance against extraction. The elements 34 temporarily hold a glue stick 16 in place near the center of the chamber 32 until it is pushed forward to be engaged by the grippers of the trigger 18 to advance the glue stick 16 forward.

In practice, the operator would load each glue stick 16 into each chamber 32 with the cylinder 26 rotated just to the left or right of the glue stick entry port 14. This allows the glue stick 16 to be inserted into the chamber 32 until it hits the back of the glue gun 10 and must stop. This is actually an advantage. It aligns each glue stick 16 so they are all even and in line with the rear of the cylinder 26. This makes it very easy for the operator to see when the cylinder 26 is rotated to the correct center position for easy insertion of a glue stick 16 into the entry port 14 of the glue gun 10.

The cylinder 26 itself is of a length sufficient to the dimensions of the glue gun 10 to accommodate insertion of the glue stick into the cylinder 26 having enough length to reach the trigger controlled rubber grippers to progress the glue stick 16 and also long enough to protrude from the back of a chamber 32 so that the glue stick 16 may be advanced by the hand or finger to reach the gripper before becoming even with the back of the chamber 32, preventing any further progression. A preferred embodiment example would be a 2" long chamber 32 with a 4" glue stick. The diameter of the cylinder 26 is sufficient to hold the desired amount of glue sticks and yet not so large that it would interfere with the use of the gun 10 in application or the operation of the gun by interfering with holding the glue gun's handle. To ensure this advantage given conventional glue gun arrangements, the cylinder 26 is shorter than the distance from the glue stick entry port 14 to the nozzle 22.

Ergonomics plays an important part in the advantage of this new device. In practice using the current glue gun design, one hand is controlling the object or objects to be glued. The other hand is holding the glue gun simultaneously pulling the trigger to advance more glue. However, when the glue stick is used up everything must stop potentially ruining the gluing operation. The operator only has two hands. This requires that the glue gun be put down so that same hand can grab a new stick and insert it into the glue stick port. Only then can the gun be picked back up and presume gluing. With the cylinder 26, the gun does not have to be put down to utilize a new glue stick. While still holding the gun, the operator may use thumb and or fingers to rotate the cylinder 26 putting a new glue stick in line with the glue stick entry port. Even if the operator is a small adult or even a child, the human hand is large enough to span the thumb back to reach the end of the glue stick and push it forward without letting go of the gun.

Thus, an improved hot gluing system has been shown and described. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A charging cylinder for a hot melt glue gun having a glue stick entry port, a nozzle, a barrel aligned with the entry port and extending to the nozzle and hot melt glue sticks, comprising a shaft extending rearwardly from the glue gun and spaced laterally from the glue stick entry port a first distance;

a cylinder rotatably mounted about the shaft and including a plurality of chambers parallel to the shaft and equidistantly spaced from the shaft by the first distance, each chamber having a passage therethrough open at both ends to receive the hot melt glue sticks, having a cross section matching the glue stick entry port and aligning with the glue stick entry port through rotation of the cylinder about the shaft.

2. The charging cylinder of claim 1, each chamber further including at least one elastic friction element extending into the passage to resist extraction of the hot melt glue sticks.

3. The charging cylinder of claim 2, there being a plurality of the elastic friction elements in each chamber, the elastic friction elements being inclined toward the hot melt glue gun to bias resistance to extraction away from the hot melt glue gun.

4. The charging cylinder of claim 1, the passage of each chamber being shorter than the hot melt glue gun barrel.

* * * * *